United States Patent [19]

Ross

[11] 4,032,025

[45] June 28, 1977

[54] BACKHOE BUCKET TILT

[75] Inventor: Warren N. Ross, Hermiston, Oreg.

[73] Assignee: Audie B. Tomlinson, Cove, Oreg.

[22] Filed: June 20, 1975

[21] Appl. No.: 588,702

[52] U.S. Cl. ..... 214/138 R; 37/103; 37/118 R; 92/118; 403/31

[51] Int. Cl.[2] ..... E02F 3/86

[58] Field of Search ..... 214/768, 138 R, 145 R; 37/103, 118 R; 280/463, 478 R, 479 R; 403/31, 57, 58; 92/118, 166

[56] References Cited

UNITED STATES PATENTS

| | | | |
|---|---|---|---|
| 1,385,215 | 7/1921 | Lidstone | 92/118 X |
| 2,927,706 | 3/1960 | Mork | 214/145 X |
| 3,002,638 | 10/1961 | Needy | 214/778 |
| 3,096,077 | 7/1963 | Forsyth | 92/166 X |
| 3,231,116 | 1/1966 | Powell | 214/145 X |
| 3,343,693 | 9/1967 | Becker | 214/138 R |
| 3,445,016 | 5/1969 | Tomlinson | 214/138 R |
| 3,462,029 | 8/1969 | Mork | 214/138 R |
| 3,550,794 | 12/1970 | Suuerkrop | 214/138 R |
| 3,881,612 | 5/1975 | Wells | 214/138 R X |
| R23,041 | 9/1948 | Smith | 92/166 X |

FOREIGN PATENTS OR APPLICATIONS

| | | | |
|---|---|---|---|
| 623,432 | 12/1935 | Germany | 280/478 R |
| 1,142,320 | 1/1963 | Germany | 214/138 R |
| 6,515,990 | 6/1967 | Netherlands | 37/118 R |
| 1,049,307 | 11/1966 | United Kingdom | 214/138 R |

*Primary Examiner*—Edgar S. Burr
*Assistant Examiner*—Steven A. Bratlie
*Attorney, Agent, or Firm*—Klarquist, Sparkman, Campbell, Leigh, Hall & Whinston

[57] ABSTRACT

A backhoe has a main boom mounting a jib boom rotatably and pivotally. The jib boom journals a yoke about one axis and a bucket is pivotal on the yoke about a transverse axis and a hydraulic cylinder drive having a double-ended piston extending between arms of the yoke is adjustable to tilt the bucket to keep its lower edge level when desired.

4 Claims, 3 Drawing Figures

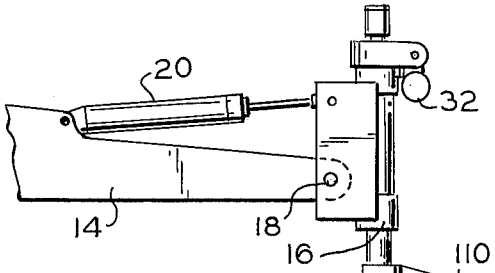
FIG. 1
FIG. 2
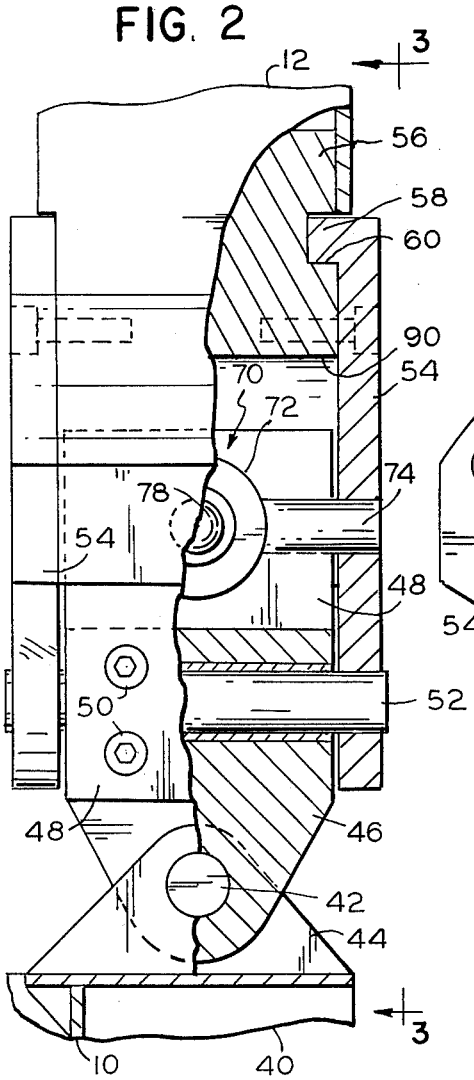
FIG. 3
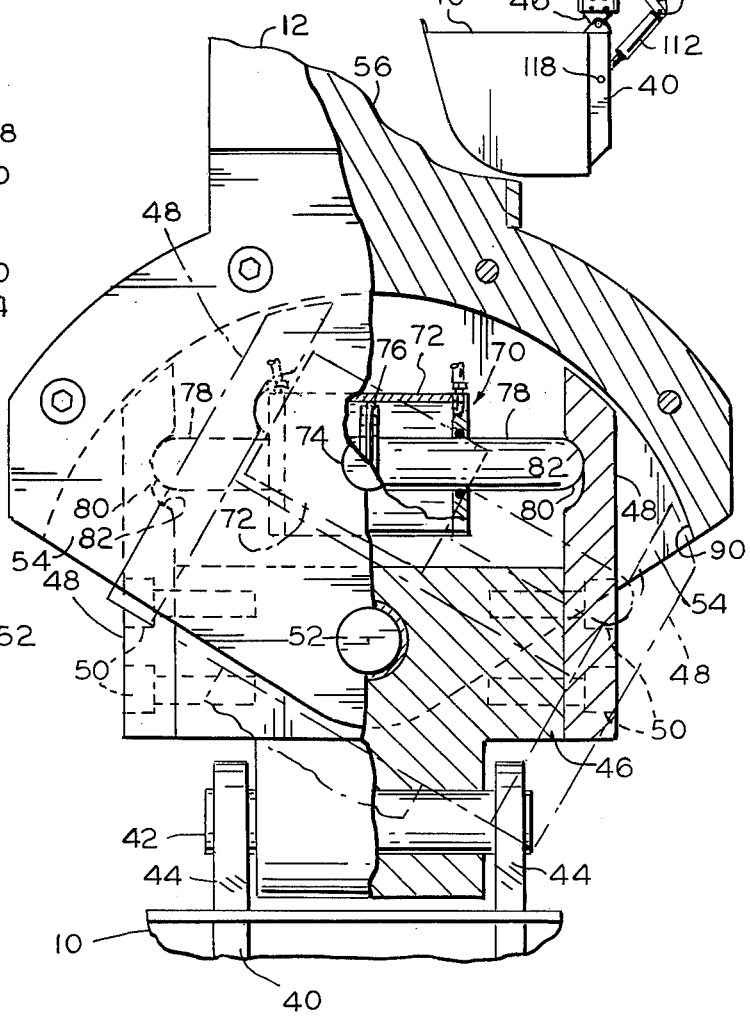

BACKHOE BUCKET TILT

DESCRIPTION

This invention relates to an improved backhoe bucket tilt, and has for an object thereof the provision of an improved backhoe bucket tilt.

Another object of the invention is to provide a backhoe having a bucket pivot which is selectively adjustable for tilt by a hydraulic cylinder drive having a double-ended piston.

In the drawings:

FIG. 1 is a fragmentary, side elevation view of an improved backhow bucket tilt forming one embodiment of the invention;

FIG. 2 is an enlarged, fragmentary, partially sectional side elevational view of the improved backhoe bucket tilt of FIG. 1; and, FIG. 3 is an enlarged, fragmentary, partially sectional front elevation view taken along line 3—3 of FIG. 2.

Referring now in detail to the drawings, there is shown therein an improved backhoe bucket tilet forming one embodiment of the invention and including a bucket 10 mounted for powered, limited universal movement on a jib boom 12, which is carried by and is rotatable 360° relative to a main boom 14 of the backhoe. A cylindrical housing 16 is pivotally connected by stub axles 18 to the main boom, and is pivotal on the axles by a hydraulic cylinder drive 20. The jib boom is rotatable in the housing 16, and can be rotatably adjusted by a motor drive 32.

The bucket 10 has a strongback frame 40, and is mounted pivotally on a generally horizontal bucket pivot axis pin 42 by a clevis portion 44. The pin 42 is carried by lower end of a yoke 46 having arms 48 rigidly secured thereto by capscrews 50. The yoke is pivotally mounted on a tilt axis pin 52 carried by cover plates 54 bolted to block 56 and keyed to the block by keys 58 in slot 60. The block 56 is welded to the lower end portion of the jib boom 12. A hydraulic cylinder drive 70 includes a cylinder 72 carried by trunnions 74 journaled in the plates 54 for pivotal movement of the cylinder on an axis spaced close to and parallel to the tilt axis pin 52. The drive 70 includes a double-ended piston construction including a piston 76 having a sealing ring, and two piston rods 78 having rounded ends 80, which abut the arms 48 in rounded, grooves or sockets 82. The sockets 82 have a longer radius than that of the rounded ends 80 to permit the shift of the rod ends relative to the arms that occurs when the yoke is moved from one position to tilt to another.

The ends of the yoke arms 48 are rounded and are close to arcuate surface 90 of the block to keep out dirt and debris. The covers 54 also keep out dirt and debris.

The piston 76 may be shifted in the cylinder 72 and then locked in the adjusted position by known valving (not shown) under the control of the operator. Shifting of the piston 76 pivots the yoke 46 to adjust the sidewise tilt of the bucket. The bucket 10 is pivotal transversely to the tile by cylinder drives 110 and 112. The cylinder drive is connected to the drive 110 and links 114 by a universal joint 116, and a universal joint 118 connects the drive 112 to the bucket to allow for tilt of the bucket.

What is claimed is:

1. In a backhoe, a main boom, a jib boom having an upper end and a lower end, a forked member having an upper end rigidly secured to the lower end of the jib boom and having a lower bifurcated end, a yoke pivotally mounted on the lower bifurcated end of the forked member on a tilt axis and having its arms extending upwardly between said bifurcated end, a bucket pivotally mounted on the lower end of the yoke for pivotal movement on the yoke on a bucket pivot axis transverse to said tilt axis, first manually controlled means for pivoting the bucket about said bucket pivot axis, a double-ended fluid cylinder pivotally mounted between the bifurcated end of the forked member on a third axis above and parallel to said tilt axis locating said cylinder between the arms of the yoke, said fluid cylinder including a housing having a central piston and a rod at each end extending outwardly of said housing parallel to said bucket pivot axis, one rod engaging with one arm of the yoke and the other rod engaging with the other arm of the yoke, the total length of the rods at least equal to the spacing between the arms of the yoke so that the rods always engage both arms, second manually controlled means for said fluid cylinder, the extension of a selected rod resulting in the simultaneous retraction of the other rod and the exertion of a direct force upon a selected arm of the yoke by said selected rod thereby selectively pivoting said yoke and bucket around said tilt axis by said selected rod.

2. The backhoe of claim 1 wherein the rods have rounded ends and wherein the arms of the yoke have socket portions receiving the rounded ends of the rods.

3. In a backhoe, a main boom, a jib boom having an upper end and a lower end, means mounting the upper end of the jib boom on the main boom for rotating and tilting adjustment relative thereto, a forked member having an upper end rigidly secured to the lower end of the jib boom and having a lower bifurcated end, a yoke pivotally mounted on the lower bifurcated end of the forked member on a tilt axis and having its arms extending upwardly between said bifurcated end, a bucket pivotally mounted on the lower end of the yoke for pivotal movement on the yoke on a bucket pivot axis transverse to said tilt axis, a double-ended fluid cylinder pivotally mounted between the bifurcated end of the forked member on a third axis above and parallel to said tilt axis locating said cylinder between the arms of the yoke, said fluid cylinder including a housing having a central piston and a rod at each end extending outwardly of said housing parallel to said bucket pivot axis, one rod engaging with one arm of the yoke and the other rod engaging with the other arm of the yoke, the total length of the rods at least equal to the spacing between the arms of the yoke so that the rods always engage both arms, the extension of a selected rod resulting in the simultaneous retraction of the other rod and the exertion of a direct force upon a selected arm of the yoke by said selected rod thereby selectively pivoting said yoke and bucket around said tilt axis by said selected cylinder rod.

4. The backhoe of claim 3, wherein the rods have rounded ends and wherein the arms of the yoke have socket portions receiving the rounded ends of the rods.

* * * * *